US006170171B1

(12) United States Patent
Schmidbauer et al.

(10) Patent No.: US 6,170,171 B1
(45) Date of Patent: Jan. 9, 2001

(54) VACUUM DRYING OF SEMICONDUCTOR FRAGMENTS

(75) Inventors: Wilhelm Schmidbauer, Emmerting; Hanns Wochner, Burghausen; Werner Ott, Tann, all of (DE)

(73) Assignee: Wacker-Chemie GmbH, Munich (DE)

( * ) Notice: Under 35 U.S.C. 154(b), the term of this patent shall be extended for 0 days.

(21) Appl. No.: 09/207,496

(22) Filed: Dec. 8, 1998

(30) Foreign Application Priority Data

Dec. 19, 1997 (DE) ..... 197 56 830

(51) Int. Cl.[7] ..... F26B 5/04
(52) U.S. Cl. ..... 34/406; 34/92
(58) Field of Search ..... 34/92, 233, 239, 34/408, 406, 402, 629

(56) References Cited

U.S. PATENT DOCUMENTS 5,263,264 11/1993 Sugai et al. .
5,314,509 * 5/1994 Kato et al. ..... 34/406
5,551,165 * 9/1996 Turner et al. ..... 34/92
5,732,478 3/1998 Chapman et al. .
5,759,287 * 6/1998 Chen ..... 34/412
5,791,895 * 8/1998 Kyung et al. ..... 34/92

FOREIGN PATENT DOCUMENTS 0421902A 4/1991 (EP) .
0423377A 4/1991 (EP) .
0539607A 5/1993 (EP) .
4-22125 * 1/1992 (JP) ..... 34/406

OTHER PUBLICATIONS

Patent Abstract in English Corresonding to EP0421902A.
Patent Abstracts of Japan, vol. 013, No. 139 & JP 63302521A (Mitsubishi Electric Grp), Sep. 12, 1988.

* cited by examiner

*Primary Examiner*—James C. Yeung
(74) *Attorney, Agent, or Firm*—Collard & Roe, P.C.

(57) ABSTRACT

A method and apparatus for drying semiconductor fragment material, has at least one vacuum-tight chamber with at least one receiving means for semiconductor fragment material, and there is a means for maintaining a vacuum in the apparatus.

8 Claims, No Drawings

VACUUM DRYING OF SEMICONDUCTOR FRAGMENTS

BACKGROUND OF THE INVENTION

1. Field of the Invention

The present invention relates to an apparatus and a method for drying semiconductor fragment material.

2. The Prior Art

High-purity semiconductor material is required for the production of solar cells or electronic components, such as memory elements or microprocessors. The semiconductor material is, for example, silicon, indium phosphide, germanium, gallium arsenide or gallium phosphide.

The deliberately introduced dopants are the only "impurities" which a material of this type should have in the most favorable case. It is therefore desirable to keep the concentrations of damaging impurities as small as possible.

It is frequently observed that semiconductor material that has already been produced with high purity is contaminated anew during further processing to provide the desired products. Thus, costly treatment/cleaning steps with subsequent drying operation are repeatedly necessary in order to regain the original purity. Impurity metal atoms which are incorporated into the crystal lattice of the semiconductor material disturb the charge distribution and can reduce the function of a subsequent component or can lead to the failure thereof. Consequently, it is necessary to avoid contamination of the semiconductor material by metallic impurities. However, other impurities or particles on/in the surface of the semiconductor fragment material can also have a lasting adverse effect on the subsequent melting process and lead to reject material.

This applies to silicon, which is the most frequently used semiconductor material in the electronics industry.

High-purity silicon is obtained by chemical reaction of the raw silicon into a liquid silicon compound (for example trichlorosilane). This can be worked up to a form of ultra-high purity with the aid of distillation processes. In a subsequent chemical deposition process, this high-purity silicon compound is then converted into high-purity silicon. It is obtained as an intermediate product in the process as polycrystalline silicon in the form of rods.

The same applies analogously to the other semiconductor materials. They, too, are predominantly produced firstly as a polycrystalline intermediate product.

Most of this polycrystalline semiconductor material is used for the production of crucible-pulled single crystals, or for producing tapes and films. It can also be used for the production of polycrystalline solar cell base material.

Since these products are produced from high-purity, molten semiconductor material, it is necessary to melt solid semiconductor material in crucibles.

To make this operation as effective as possible, it is necessary to produce large-volume solid semiconductor pieces of defined fragment size distribution. There are precisely specified requirements made of the surface purity for technical process reasons. No impurities are allowed to pass into the crucible with the semiconductor fragment material. The surface of the semiconductor fragments must be dry and free from dust and acid. Otherwise—particularly in the case of single crystal growth—impurity particles lead to dislocations and lattice defects and make it impossible to effect crystal growth successfully.

In order to produce high-purity semiconductor fragment material, the polycrystalline semiconductor material (such as the above-mentioned polycrystalline silicon rods) or indeed monocrystalline semiconductor recycling material is comminuted before being melted. This is usually associated with superficial contamination of the semiconductor fragment material. This is because the comminution is predominantly carried out using mechanical breaking tools, such as metallic or ceramic jaw or roll-type crushers, hammers or chisels. As a result of the comminution operation, impurity atoms (iron, chromium, nickel, copper, etc.) are worked into the surface of the semiconductor material or adhere to the surface. However, even in the alternative breaking methods, such as water jet breaking, shock wave comminution, etc., it is not entirely possible to preclude such contamination. Examples of this contamination are with impurity atoms or the possibility of damaging dust and/or particles from reaching the fragment surface.

In particular, contamination by metal atoms is to be regarded as critical since these can alter the electrical properties of the semiconductor material in a damaging manner. Dust and/or particles on the surface can have a lasting adverse effect on the subsequent pulling process (dislocations, etc.).

In order to be able to use mechanically processed semiconductor material as starting material for the further production process, the following is necessary. First, it is necessary to reduce the concentration of metal ions and particles which have made their way onto or into the surface of the mechanically processed semiconductor material as a result of the processing operation and handling.

Thus, before being melted, the semiconductor fragments must be subjected to a chemical surface treatment with subsequent cleaning and drying in order to achieve the specified purity values for the surface.

For this purpose, the surface of the mechanically processed semiconductor material is etched using diverse acids, such as a mixture of nitric acid and hydrofluoric acid. This process is widely used. Afterwards the semiconductor fragment material, for example, polycrystalline silicon fragments, is usually rinsed with ultrapure water and dried. Since no impurities are allowed to pass into the crucible with the semiconductor material, the surface/surface structure of the semiconductor fragment material must be absolutely dry and free from dust, specks and acid.

Semiconductor material is very brittle. Therefore, the breaking operation yields a sharp-edged, fissured semiconductor fragment material having a multiplicity of fine hairline cracks. These cracks will have propagated as far as the cm range under the surface. In particular, residual moisture (water and acid residues) forms in these cracks on account of the capillary effect. This residual moisture can subsequently lead to contamination (specks), to reject material, or even to cauterization. In order to fulfill the high quality requirements, which are continually being made more stringent, satisfactory drying is required. That is to say acid-free and speck-free semiconductor fragment material is absolutely necessary.

Conventional convection drying is by sending a stream of ultrapure air over and/or through the material being dried. This does not afford the success hoped for in an appropriate period of time (less than one hour), which can be discerned inter alia from the coloration of litmus paper, unless complicated, bulky and thus costly equipment is set up or the material is stored unpackaged "in the open" for a relatively long period of time. In this case the risk of intensified dust contamination is very high. A further disadvantage of convection drying is that moisture remains in the extremely fine hairline cracks and thus the risk of subsequent specking/dust contamination is increased. This leads to a quality deterioration and possibly even to rejects.

In the case of radiation drying, the upper layer is primarily heated, with the result that areas on the "shadow side" of the semiconductor fragment material are not heated sufficiently. Also, in the case of beds, layers deeper down are not sufficiently included. Furthermore, the removal of acid from the hairline cracks is not entirely satisfactory. This likewise leads to specking, that is to reject material.

If the radiation intensity is increased, then the surface temperature can be increased to above 100° C. This will cause metal ions that have not been cleaned away to diffuse, as the temperature increases, into the surface of the semiconductor fragment material. This will contaminate the pure semiconductor material in a sustained manner. This leads to a quality deterioration and possibly even to rejects.

The same applies analogously to drying with the use of microwaves. Here, too, diffusion of damaging metal ions into the semiconductor material will occur. Reject material is to be expected on account of the heating of the material.

Drum drying is also not practical. This is because drum abrasion occurs as a result of the movement of the fragment material between semiconductor fragment material and process drum, on the one hand. Also, between the semiconductor fragments themselves, on the other hand, there is sustained drum abrasion and/or semiconductor fine fragments/dust will occur. As a result of this the subsequent pulling process is greatly impaired (high dislocation rate) and likewise leads to reject material.

SUMMARY OF THE INVENTION

It is an object of the invention to overcome the disadvantages of the prior art and to provide a dust-free, speck-free and acid-free drying of semiconductor fragment material, which is to be carried out in an efficient and economical manner.

The present invention is directed to an apparatus for drying semiconductor fragment material which has at least one vacuum-tight chamber with at least one receiving means for semiconductor fragment material, and means for maintaining a vacuum in the apparatus.

The apparatus of the invention for drying semiconductor fragment material has at least one vacuum-tight device, which may be a vacuum drying chamber having a lid that can be opened in order to introduce the semiconductor fragment material and can be closed off in a vacuum-tight manner. The vacuum drying chamber preferably is wall-heated.

There is preferably an opening in the upper region of the vacuum drying chamber through which dry ultrapure air having a relative humidity of less than 20% can flow in. Or preferably pure inert gases, for example nitrogen, argon, etc., can flow in. Both the air or the inert gas can be at a temperature of 20° C. to 90° C., preferably approximately 80° C., and at a gas volumetric flow rate of, preferably, 2 to 20 $m^3/h$ and can flow in. Situated in the lower region is a vacuum pump having a high suction capacity, which generates a pressure of $10^{-2}$ to $10^{-5}$ mbar, preferably $10^{-3}$ to $10^{-4}$ mbar, and has a suction capacity of 30 $m^3/h$ to 250 $m^3/h$, preferably 100 $m^3/h$ to 200 $m^3/h$.

The suction capacity is dependent on the number of receiving apparati or process trays to be dried and on the quantity of semiconductor fragment material (the product throughput) to be dried therein. The suction capacity also depends on the material layering (single-layered or multilayered) and/or on the semiconductor fragment structure/size. This suction capacity depends on the vacuum drying chamber size resulting therefrom. A receiving apparatus or means, preferably having openings, is inserted into this vacuum drying chamber. These openings are preferably in the bottom (perforated bottom). This apparatus or means contains the semiconductor fragment material which preferably has a grain size distribution of 2 mm to 150 mm.

This vacuum drying chamber is preferably a container made of stainless steel (VA-2 or VA-4) which is either electropolished or lined with clean room-conforming and temperature-resistant materials such as, preferably, silicon or the plastics TEFLON® and PFA. The inserted receiving apparatus or process tray is seated on a sealing strip. The result is that heated ultrapure air and/or pure inert gas can necessarily flow through the receiving apparatus. That is to say it will flow through the semiconductor fragment material, via the perforated bottom. In this case, the cycle or residence time preferably lies in a range from 2 to 10 min. The time is dependent on fragment structure and size, suction capacity of the vacuum pump, batch quantity and gas volumetric flow rate.

This vacuum drying chamber may additionally be preceded (as it were for predrying) by a customary apparatus for convection drying. This convection drying apparatus is a chamber through which dry ultrapure air having an air humidity of less than 20% and a temperature of 60 to 100° C., preferably 70 to 90° C., can flow in. The air flow is from above through, preferably, a temperature-resistant laminar air flow hood. The use of this and the drying time are dependent on the quantity and nature of the material (fragment size/structure) and is preferably 0 min to 1 h at a throughput of 250 kg/h.

The present invention is also directed to a method for drying semiconductor fragment material in which the semiconductor fragment material is dried in a vacuum.

In the method of the invention for drying semiconductor fragment material, the semiconductor fragment material, which is preheated in a previous cleaning step with ultrapure water preferably at 80° C., is dried, preferably, in a vacuum drying chamber such as that described above. This vacuum drying chamber is evacuated by means of a vacuum pump. This vacuum pump has a high suction capacity, for example to a pressure of $10^{-2}$ mbar to $10^{-5}$ mbar, and preferably from $10^{-3}$ to $10^{-4}$ mbar. The suction capacity of the vacuum pump ranges from 30 $m^3/h$ to 250 $m^3/h$, and preferably from 100 to 200 $m^3/h$. The suction capacity is dependent on the number of receiving apparati, such as process trays to be dried and on the quantity of semiconductor fragment material (the product throughput) to be dried therein. The suction capacity also depends upon the material layering (single-layered or multilayered) and/or on the semiconductor fragment structure/size. Thus the suction capacity must be adequate for the size of the vacuum drying chamber resulting therefrom.

This evacuation operation removes the residual moisture from the so-called hairline cracks in the semiconductor fragment materials. After the vacuum drying chamber has been evacuated, it is flooded with dry ultrapure air having a relative humidity of less than 20%. Also, it can be flooded with pure inert gases, for example nitrogen, argon, etc. Both the air or the inert gas is at a temperature of 20 to 90° C., preferably approximately 80° C., and a gas volumetric flow rate of 2 to 20 $m^3/h$. The interplay of evacuation and flooding with ultrapure air and/or pure inert gas is preferably carried out one to three times dependent on the fragment size and/or on the fragment structure.

In a preferred embodiment, the receiving apparatus is seated on a sealing strip in the vacuum drying chamber. The semiconductor fragment material is necessarily subjected to a flowthrough during the flooding and evacuation. This promotes the moisture absorption by the ultrapure air and/or by the inert gas and accelerates and intensifies the drying operation.

The evacuation and flooding of the vacuum drying chamber preferably take from 5 to 60 min at a flow rate of 250 kg/h. The time required is dependent on the vacuum chamber size, on the fragment size and/or on the fragment structure. The ultrapure air/gas volumetric flow rate preferably ranges from 2 to 20 $m^3$/h.

If required, the vacuum drying may be preceded by a predrying step using conventional convection drying which is dependent on the fragment size and/or fragment structure. During this convection drying, preferably dry ultrapure air is used having a relative humidity of less than 20% at a temperature of 20 to 90° C., and preferably 60 to 90° C. This ultrapure air preferably flows necessarily through the receiving apparatus. The ultrapure air preferably flows in by means of a laminar air flow hood.

If vacuum drying is solely carried out, it preferably takes 10 min to 60 min. If convection drying is carried out beforehand, the total drying time preferably ranges from 20 min to 120 min. These times relate to a flow rate of semiconductor fragment material of, preferably, 250 kg/h.

After the drying according to the invention, the semiconductor fragment material is cooled to a maximum temperature of 30° C. The cooling step occurs in an adjoining partitioned conveying section which preferably has a conventional laminar flow hood complying with the clean room class 10 to 1000, before it is welded into foil in a packaging apparatus.

In order to reduce contamination during the individual process steps, a laminar air flow hood, for example conforming to the clean room class 100, is preferably built over the process production line.

The advantage of vacuum drying over drying by means of the customary convection/radiation drying includes the fact that it is possible to dry the semiconductor fragment material completely at temperatures of below 100°C. In particular, no residual moisture, such as water and acid residues, remains in the microstructure, for example the fine hairline cracks in the surface of the semiconductor fragment material. Consequently, the risk of subsequent specking and/or cauterization or dust contamination is reduced. Furthermore, since no temperatures of above 100° C. are necessary, the disadvantageous process does not occur. In this disadvantageous process, impurity metal ions diffuse into the semiconductor material, which occurs during radiation drying. Consequently, it is possible to produce a semiconductor fragment material which satisfies the highest quality requirements.

Furthermore, the technical plant outlay, in particular the size or spatial dimensioning of the drying device can be distinctly reduced. This will provide a saving of production area. For example, a conventional convection drying encompasses several meters, whereas vacuum drying lies in the meter range. In this case, the size and extent of the technical climate-control and clean-room equipment can also be correspondingly distinctly reduced. Hence, capital expenditure and also routine operating/energy costs can be reduced. On account of its small spatial dimensions, vacuum drying can advantageously be set up modularly and thus incorporated relatively simply into existing production runs.

Accordingly, while a few embodiments of the present invention have been shown and described, it is to be understood that many changes and modifications may be made thereunto without departing from the spirit and scope of the invention as defined in the appended claims.

What is claimed is:

1. A method for drying semiconductor fragment material comprising cleaning semiconductor fragment material with ultrapure water; and drying the semiconductor fragment material in a vacuum by repeatedly applying a vacuum and alternatingly flooding the material with a substance selected from the group consisting of dry ultrapure air and a dry inert gas.

2. The method for drying semiconductor fragment material as claimed in claim 1, further comprising predrying the semiconductor fragment material by means of at least one convection drying step.

3. The method for drying semiconductor fragment material as claimed in claim 1, wherein the dry ultrapure air and the dry inert gas each has a relative humidity of less than 20%.

4. The method for drying semiconductor fragment material as claimed in claim 1, wherein the dry inert gas is a pure dry inert gas.

5. The method for drying semiconductor fragment material as claimed in claim 1, wherein the dry inert gas is a pure dry inert gas selected from the group consisting of nitrogen and argon.

6. The method for drying semiconductor fragment material as claimed in claim 5, wherein the dry pure inert gas is nitrogen.

7. The method for drying semiconductor fragment material as claimed in claim 5, wherein the dry pure inert gas is argon.

8. The method for drying semiconductor fragment material as claimed in claim 1, comprising applying the dry ultrapure air and the dry inert gas each in a laminar air flow.

* * * * *